US011719093B2

(12) United States Patent
Roessler et al.

(10) Patent No.: US 11,719,093 B2
(45) Date of Patent: Aug. 8, 2023

(54) VALVE STATUS INDICATOR SYSTEM AND METHOD

(71) Applicant: GEODYNAMICS, INC., Millsap, TX (US)

(72) Inventors: Dennis Roessler, Fort Worth, TX (US); John Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 17/742,592

(22) Filed: May 12, 2022

(65) Prior Publication Data

US 2022/0268149 A1 Aug. 25, 2022

Related U.S. Application Data

(62) Division of application No. 16/790,248, filed on Feb. 13, 2020, now Pat. No. 11,608,737.

(60) Provisional application No. 62/807,522, filed on Feb. 19, 2019.

(51) Int. Cl.

| | |
|---|---|
| ***E21B 43/11*** | (2006.01) |
| ***E21B 47/11*** | (2012.01) |
| ***E21B 34/06*** | (2006.01) |

(52) U.S. Cl.
CPC ..... *E21B 47/11* (2020.05); *E21B 34/063* (2013.01)

(58) Field of Classification Search
None
See application file for complete search history.

(56) References Cited

U.S. PATENT DOCUMENTS

| | | | | |
|---|---|---|---|---|
| 2010/0108148 | A1* | 5/2010 | Chen | F16K 31/001 137/505.36 |
| 2013/0091943 | A1* | 4/2013 | Skillingstad | E21B 47/11 73/152.54 |
| 2016/0084075 | A1* | 3/2016 | Ingraham | E21B 23/01 166/53 |

* cited by examiner

*Primary Examiner* — Charles R Nold
(74) *Attorney, Agent, or Firm* — Morgan, Lewis & Bockius LLP

(57) ABSTRACT

A fluid control system includes a fluid control device configured to be connected to at least one of two casing elements in a well, for controlling a fluid flow between a bore of the fluid control device and a zone located outside the casing elements; and a tracer material located within an inner chamber of a body of the fluid control device, the tracer material being uniquely associated with the fluid control device. The fluid control device is configured to release, when activated, the tracer material out of the inner chamber.

3 Claims, 14 Drawing Sheets

VALVE STATUS INDICATOR SYSTEM AND METHOD

BACKGROUND

Technical Field

Embodiments of the subject matter disclosed herein generally relate to well operations, and more specifically, to a valve status system that is capable to indicate the status of plural valves provided within the casing of the well.

Discussion of the Background

In the oil and gas field, once a well 100 is drilled to a desired depth H relative to the surface 110, as illustrated in FIG. 1, and the casing 102 protecting the wellbore 104 has been installed and cemented in place, it is time to connect the wellbore 104 to the subterranean formation(s) 106 to extract the oil and/or gas. This process of connecting the wellbore to the subterranean formation may follow two different approaches.

According to a first approach, as illustrated in FIG. 1, it is possible to perform first a step of isolating a stage of the casing 102 with a plug 112, a step of perforating the casing 102 with a perforating gun assembly 114 such that various channels 116 are formed to connect the subterranean formations to the inside of the casing 102, a step of removing the perforating gun assembly, and a step of fracturing the various channels 116.

Some of these steps require to lower into the well 100 a wireline 118 or equivalent tool, which is electrically and mechanically connected to the perforating gun assembly 114, and to activate the gun assembly and/or a setting tool 120 attached to the perforating gun assembly. Setting tool 120 is configured to hold the plug 112 prior to isolating a stage and also to set the plug. FIG. 1 shows the setting tool 120 disconnected from the plug 112, indicating that the plug has been set inside the casing.

FIG. 1 shows the wireline 118, which includes at least one electrical connector, being connected to a control interface 122, located on the ground 110, above the well 100. An operator of the control interface may send electrical signals to the perforating gun assembly and/or setting tool for (1) setting the plug 112 and (2) disconnecting the setting tool from the plug. A fluid 124, (e.g., water, water and sand, fracturing fluid, etc.) may be pumped by a pumping system 126, down the well, for moving the perforating gun assembly and the setting tool to a desired location, e.g., where the plug 112 needs to be deployed, and also for fracturing purposes.

The above operations may be repeated multiple times for perforating and/or fracturing the casing at multiple locations, corresponding to different stages of the well. Note that in this case, multiple plugs 112 and 112' may be used for isolating the respective stages from each other during the perforating phase and/or fracturing phase.

These completion operations may require several plugs run in series or several different plug types run in series. For example, within a given completion and/or production activity, the well may require several hundred plugs depending on the productivity, depths, and geophysics of each well. Subsequently, production of hydrocarbons from these zones requires that the sequentially set plugs be removed from the well. In order to reestablish flow past the existing plugs, an operator must remove and/or destroy the plugs by milling or drilling the plugs.

However, according to a second approach, as illustrated in FIG. 2, it is possible to equip the casing 102 with plural valves 202-1 to 202-3 (only three are shown for convenience, but the casing can have many more) that when opened, ensure the fluid communication between the wellbore 104 and the formation 106. This means that with such a casing, there is no need to use perforating guns for perforating the casing to establish a fluid communication between the bore and the formation. However, for such a casing, one or more of the plural valves 202-1 to 2023 may fail to open, which would negatively affect the performance of the well. The current casing valves have limited means of informing the operator at the surface if the valve has opened or not. Blockages in the casing, such as pumping equipment, restrictions, etc. prevent simple identification schemes from being used.

For these reasons, most of the current valve based casings typically rely upon pressure drop measurements at the surface as an indication if a valve has opened. According to this approach, when a valve 202-1 is opened, the pressure inside the wellbore 104 is expected to drop, as the pumping system 126 creates a pressure in the wellbore that is larger than the pressure in the formation 106 and thus, the well fluid flows into the formation. Thus, by monitoring at the surface the pressure variations in the borewell, it is possible for an experienced operator to infer when a valve has been opened.

With multiple valves provided along the casing (e.g., hundreds), it is very difficult to determine which ones opened. Prior art devices that rely upon the release of large sized identifiers (e.g., a ball) into the flow stream have limited utility due to the restrictions in the flow path presented by the various production equipment.

In a different sub-field of the oil exploration, U.S. Pat. No. 8,833,154 (the '154 patent herein) presents a sand screen tool 300 that has plural valves 301-1 to 301-3. The sand screen tool 300 is lowered into the bore 104 of the well 100. Because the well 100 has no casing, the sand tool 300 is configured with a sand screen 310 that prevents the sand from the well from entering the bore of the sand screen tool. The oil that passes through the sand screen 310 is directed to the valves 301-1 to 301-3 and then allowed to enter the bore of the tool 300. A tracer element 302-1, as show in FIG. 3, is associated with each valve 301-1. The tracer element 302-1 includes a tracer material which is mechanically fractured, shaved, broken or punctured when a sleeve of the valve 301-1 opens, and because the tracer material is unique for each valve, the arrival of the tracer material at the surface provides an indication of whether the corresponding valve has been opened.

However, such a solution has its limitations. The valves 301-1 to 301-3 do not open directly to the formation 106, and to install the tracer element next to each valve is time consuming and expensive. Further, a moving element of the valve has to mechanically puncture or shred pieces of the tracer element to release tracer particles into the bore. Further, a sand screen tool is not required in many of the wells.

Thus, there is a need for finding a better system that indicates the status of the valves along the casing, a system that is easier and quicker to install.

BRIEF SUMMARY OF THE INVENTION

According to an embodiment, there is a fluid control system that includes a fluid control device configured to be connected to at least one of two casing elements in a well, for controlling a fluid flow between a bore of the fluid control device and a zone located outside the casing elements, and a tracer material located within an inner chamber of a body of the fluid control device, the tracer material being uniquely associated with the fluid control device. The fluid control device is configured to release, when activated, the tracer material out of the inner chamber.

According to another embodiment, there is a fluid control device that includes a body extending along a longitudinal axis X, the body having a bore, a port formed to extend radially through the body, an inner sleeve located within the body and configured to close the port to prevent fluid communication between the port and the bore, an actuation mechanism configured to actuate the inner sleeve to open or close the port relative to the bore, and a tracer material located within an inner chamber of the body, wherein the tracer material is released out of the inner chamber only when the inner sleeve is actuated.

According to yet another embodiment, there is a fluid control system that includes a fluid control device configured to be connected to at least one of two casing elements in a well for controlling a fluid flow between a bore of the fluid control device and a zone outside the casing elements, and a tracer material located within a moving sleeve of the fluid control device, wherein the tracer material is uniquely associated with the fluid control device, and the tracer material is released from the moving sleeve when the moving sleeve is activated.

According to another embodiment, there is a method for controlling a fluid flow in a well and the method includes providing plural fluid control devices connected to casing elements in the well, for controlling the fluid flow between a bore of the fluid control devices and a zone located external to the casing elements, lowering the plural fluid control devices and the casing elements into the well, actuating a fluid control device of the plural fluid control devices to establish the fluid flow between the bore and the zone, and releasing a tracer material from within an inner chamber of the fluid control device into the fluid flow. The tracer material is uniquely associated with the fluid control device.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to an oil well. However, the embodiments to be discussed next are not limited to an oil well, but they may be applied to other types of wells, for example, gas wells or water wells.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a novel valve status indicator system includes a containment vessel that is placed within a recess of the casing, and the containment vessel includes a tracer material. When the sleeve that closes the port formed in the recess of the casing is opened, the containment vessel is broken, releasing the tracer material. The arrival of the tracer material at the surface can be quickly identified and that tracer material is a positive indication that the corresponding port in the casing has been opened.

Figure 1:
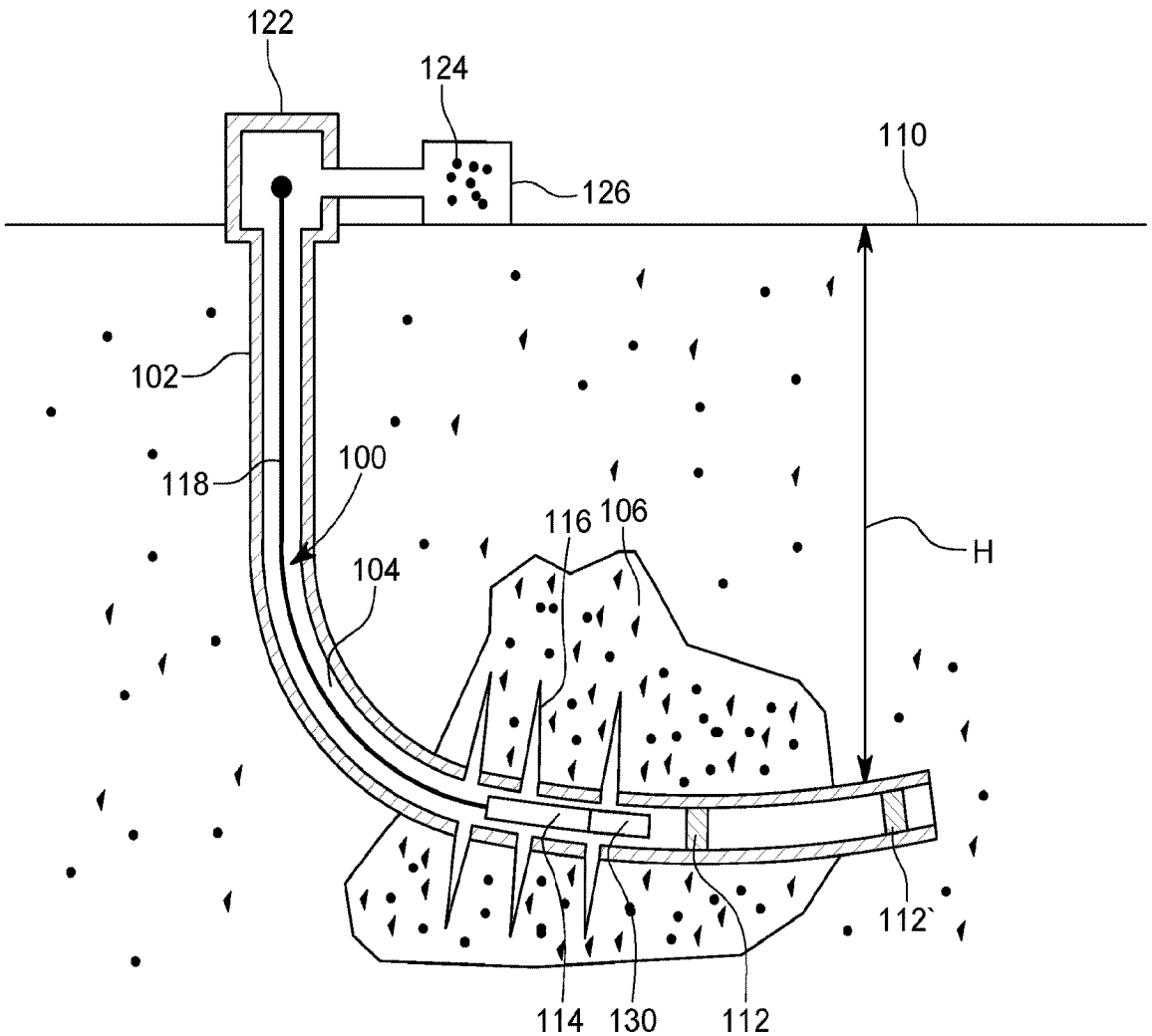
FIG. 1 (PRIOR ART)
FIG. 1 illustrates a well in which a gun is used to open fluid channels between the wellbore and the formation around the casing.
Figure 2:
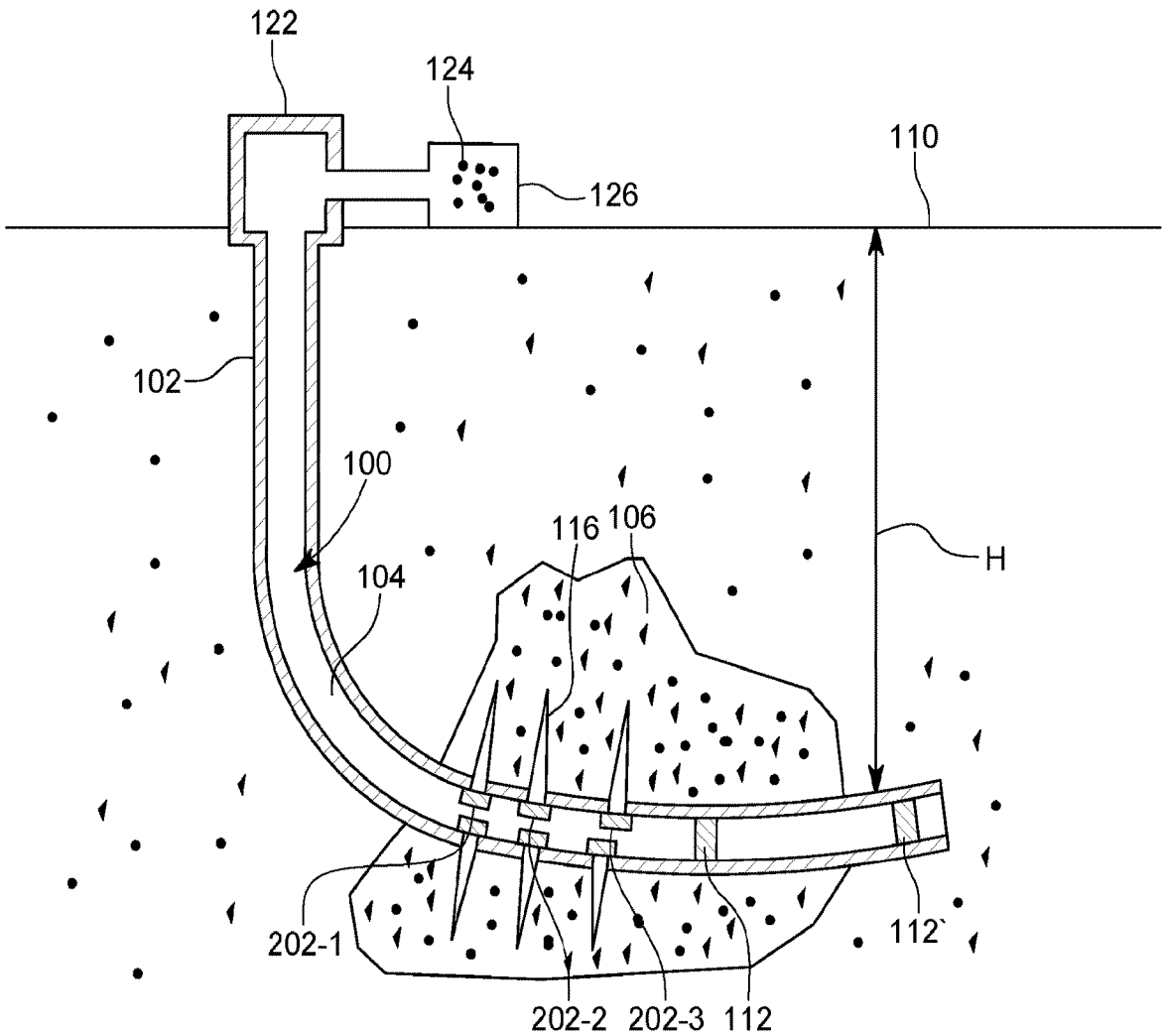
FIG. 2 (PRIOR ART)
FIG. 2 illustrates a well having a casing equipped with plural valves that can be opened remotely to establish a fluid communication between the wellbore and the formation around the casing.
Figure 3:
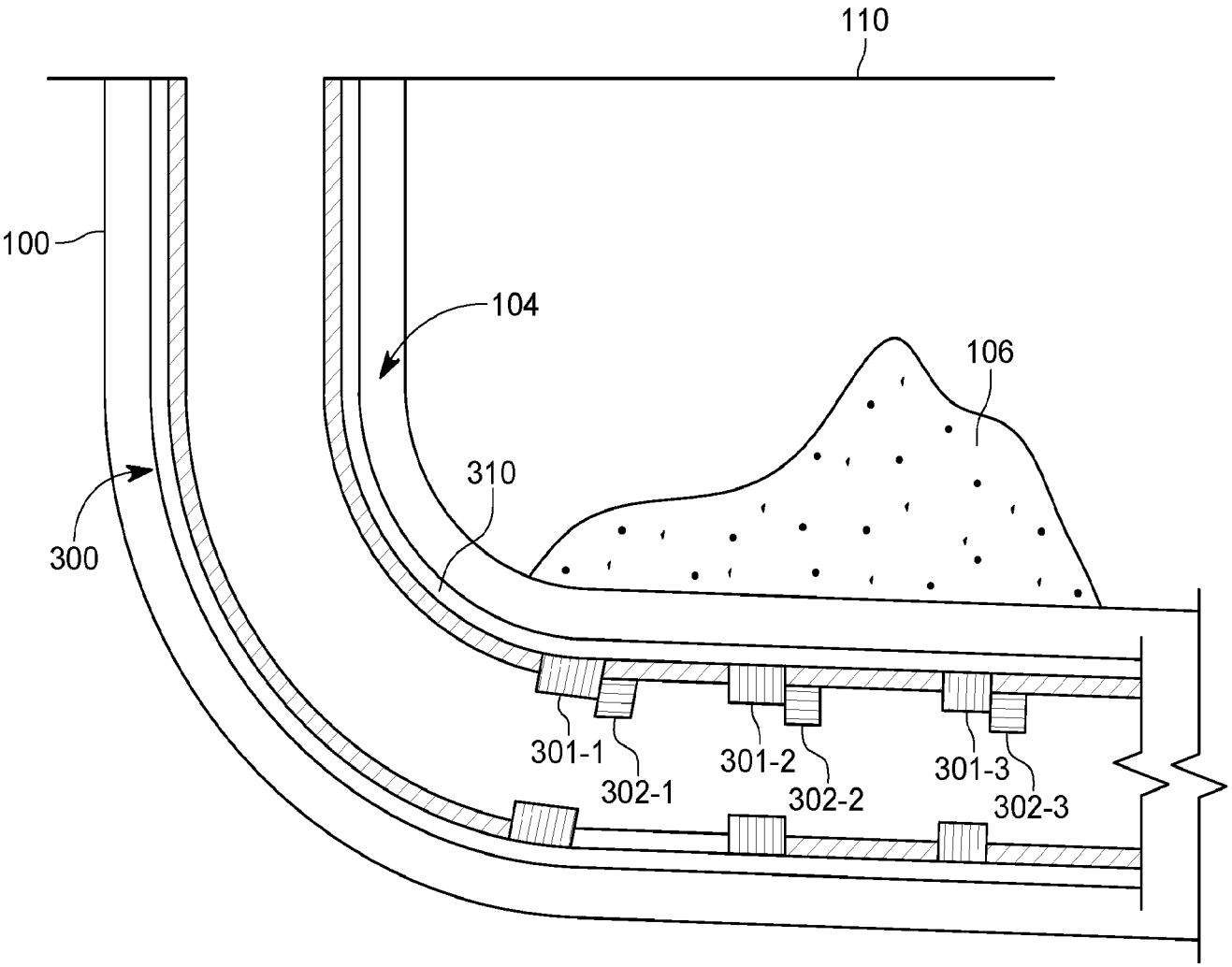
FIG. 3 (PRIOR ART)
FIG. 3 illustrates a tracer system having a tracer material that is released by a mechanical action of a sleeve in a sand screen device for identifying whether an associated valve is open.
Figure 4:
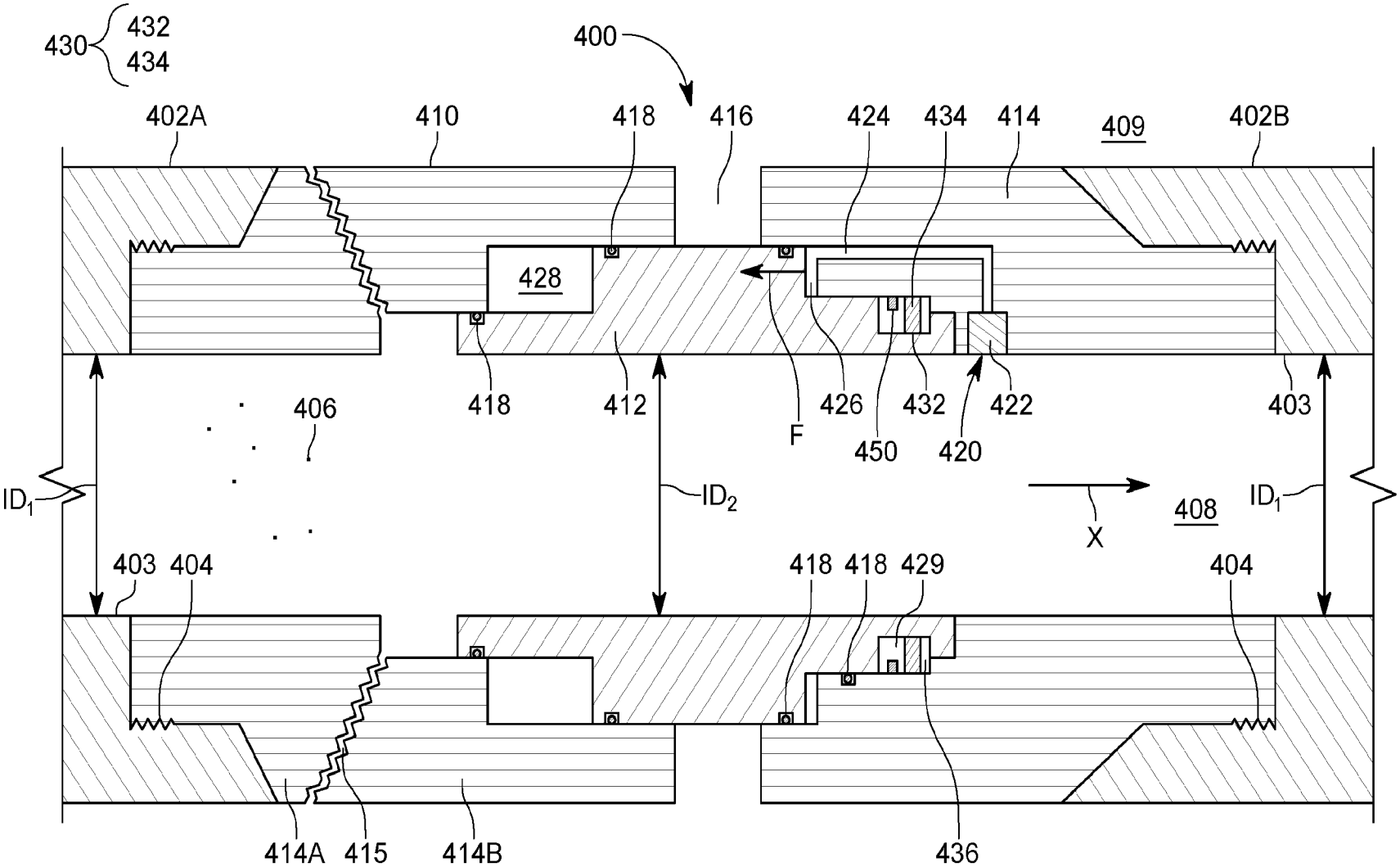
FIG. 4 illustrates a novel fluid control system equipped with a status monitoring system that indicates whether the fluid control system has been opened.

More specifically, as illustrated in FIG. 4, a casing 400 is shown to have a top casing element 402A and a bottom casing element 402B physically separated from each other, but fluidly connected to each other by a fluid control device 410. The fluid control device 410 is configured to control a fluid flow from a bore 408 of the casing to a formation 409 outside the casing, or vice versa. In one application, the fluid flow is between the bore 408 and an annulus outside the casing, as discussed later with regard to FIG. 8B. For this reason, the formation 409 and the annulus are referred herein as a zone. The fluid control device acts as a valve and can be implemented as a valve. One skilled in the art would understand that the casing 400 can have any number of casing elements, but only two are shown in the figure for simplicity. Also, the casing 400 may have any number of fluid control devices 410. The casing elements may be mechanically connected to the fluid control device 410 by corresponding threads 404, or other equivalent connecting devices. In this embodiment, an inner diameter ID1 of the casing elements is identical to an inner diameter ID2 of the fluid control device 410, so that an inner sleeve 412 of the fluid control device 410 is flush with an inner wall 403 of the casing elements. In one embodiment, it is possible that the inner sleeve 412 enters inside the borehole of the casing. Note that casing elements 402A and 402B are directly connected to the fluid control device 410 in this embodiment.

The inner sleeve 412 is configured to slide relative to a body 414 of the fluid control device 410, so that a port 416 formed in an external part of a wall of the body is closed by the inner sleeve and no fluid flow happens between the borehole 408 and the formation 409 around the casing 400. The wall of the body is understood herein to extend radially, from the bore to the formation around it. The body 414 may be manufactured to have two parts, an upper part 414A and a lower part 414B that are connected to each other, for example, by threads 415. In this way, the internal elements of the fluid control device 410 can be added in a more efficient way. The terms "upper" and "lower' are defined herein relative to a head and toe of the well, the upper part facing the head of the well and the lower part facing the toe of the well, irrespective of whether the well is horizontal, vertical, or having any other shape. One or more seals 418 may be formed at interfaces of the various elements of the fluid control device 410 to prevent a well fluid 406 to move along these interfaces. Under certain conditions, which are discussed later, the inner sleeve 412 can move along the longitudinal axis X and allow fluid communication through the port 416, between the borehole 408 of the casing and the formation 409.

The lower part 414B may include an actuation mechanism 420 for actuating the inner sleeve 412, for opening the port 416. In one implementation, the actuation mechanism 420 includes a pressure disc or burst disc 422 and a conduit 424 that fluidly connects the pressure disc 422 to a first internal chamber 426 of the fluid control device 410. The first internal chamber 426 is defined in this embodiment only by the inner sleeve 412 and the lower part 414B of the body. The pressure disc 422 is configured to break at a given pressure of the well fluid 406. At that point, the well fluid 406 from the bore 408 enters through the conduit 424 into the first chamber 426 and exerts a force F on the sleeve 412, opposite to the direction of the longitudinal axis X. A second chamber 428 is defined by the lower part 414B of the body 414 and the sleeve 412 and this chamber contains air at the atmospheric pressure. The second chamber 428 is sealed from the bore 408 and from the formation 409.

The fluid control device 410 further includes a status monitoring system 430 that is integrated into and associated with the fluid control device 410 and is configured to indicate to the operator of the well when the fluid control device 410 has opened. In one embodiment, the status monitoring system 430 is fully integrated within the body 414 of the fluid control device 410 in the sense that no part of the status monitoring system 430 extends into the bore 408 or outside of the fluid control device. This specific configuration of having the status monitoring system 430 fully located or integrated within the fluid control device 410 is understood as being "fully within a wall, or between two walls of the fluid control device, with no part sticking out into the bore or the formation." The status monitoring system 430 may be implemented as a containment vessel 432 that holds a tracer material 434. The containment vessel 432 is placed in a third chamber 429 formed between the sleeve 412 and the lower part 414B of the body 414. The containment vessel 432 may be fixedly attached to one of the sleeve or the lower part of the body or just sitting within the third chamber 429. In one embodiment, the third chamber is defined exclusively by the sleeve 412 and the lower part 414B of the body 414. However, in one embodiment, the containment vessel 432 may be omitted so that the tracer material 434 is directly placed inside the third chamber 429. In one embodiment, the second chamber 426 is insulated from the third chamber 429 so that no fluid can be exchanged between the two chambers. However, in one application, the second chamber 426 may be in fluid communication with the third chamber 429.

The tracer material 434 may include, but is not limited to, any small scale material capable of unique marking or identification, for example, DNA or DNA-like material comprising molecules of variable length, size, number of base pairs (amino acids) or sequence and/or type of amino acid base pairs; radioactive materials including nuclear or unique isotope, particle, or other materials; organic or inorganic molecules of varying molecular size, atomic composition or structure, for example, polymers of varying chain length detectable by analytical methods and instrumentation known in the art, e.g., mass spectrometry or other techniques, magnetic material, nanoparticles, nanofibers, nanorods, or other nanosized materials, etc. The type of material states may include gases, liquids, solids, and particles. Individual micro- or nano-particles may be physically marked with unique identifiers such as microdots or other tagging methods known in the art to include unique numbers, shapes, colors, color or other patterns, RFID, UPC, QR or other barcodes. Current technology has designed RFID chips that are 0.15×0.15 mm in size or smaller.

The tracer reservoir or containment vessel 432 itself may be composed or a tracer material that dissolves in the wellbore fluid 406 or another material, such as an acid, contained and released by a separate compartment of the valve. In one embodiment, the tracer reservoir may be made of a material that is degraded by the oil flowing into the bore and thus, the tracer reservoir releases the tracer material.

Combinations of different tracer materials are also contemplated herein, for example, a certain colored sphere of a particular material may identify a given group of valves, and each valve within the group is further marked with an individual RFID tag. Similar schemes may be applied wherein the DNA chain length is indicative of a subgroup of valves, while each DNA tracer within the group varies with respect to its amino acid base pair composition or sequence to identify individual valves within the group.

In one application, a tracer reservoir or containment vessel 432 of up to approximately 100 mL is possible, depending on the valve size and overall design. In one application, the tracer material 434 could be a closed cell foam ball. In the well, it would be compressed by the hydrostatic pressure —>5,000 psi. and be a small size —<2 mm. As it reaches the surface at 14.7 psi, its size would have grown due to the air inside the foam expanding. It would now be much bigger and its bulk density would be reduced, and thus it would float. It could be skimmed off the top of a surface collector tank (not shown) placed at the head of the well. In another application, the containment vessel 432 is made of a material that dissolves when in contact with the well fluid 406. In still another embodiment, the containment vessel is made of a flexible material, like a balloon or a bladder, which when exposed to the high pressure inside the wellbore, breaks and releases the tracer material 434. In still another embodiment, the containment vessel 432 is accompanied by a second reservoir 436, which may be filled with an acid or solvent that would dissolve the containment vessel 432. When the inner sleeve 412 opens, it may be configured to puncture the second reservoir 436, which releases its content so that the first containment vessel 432 is starting to dissolve. In still another application, the containment reservoir 432 is pressurized by the second reservoir 436 that, upon sleeve opening, communicates to the containment reservoir which then causes the tracer to disperse into the wellbore.

Figure 5:
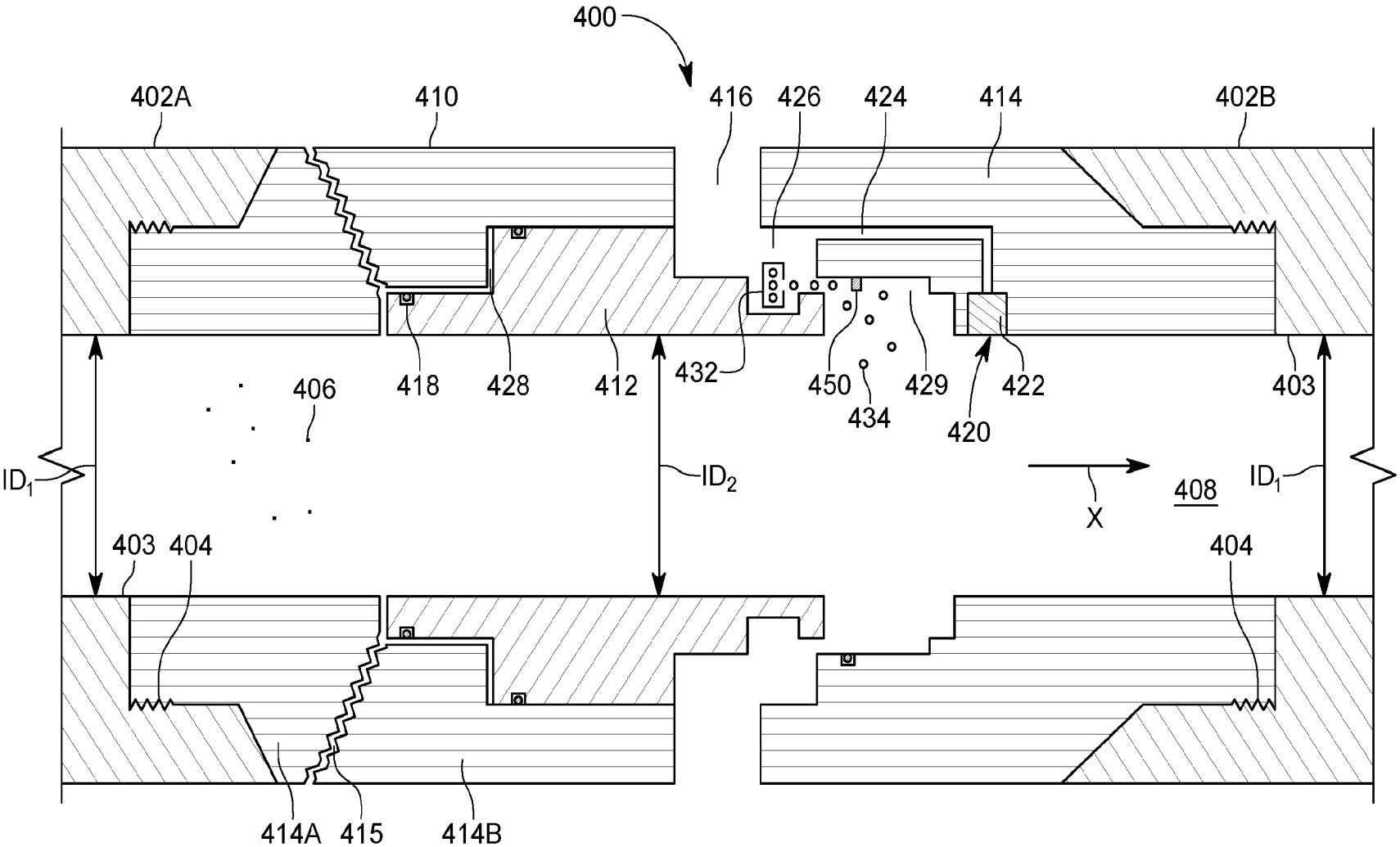
FIG. 5 illustrates the fluid control system being opened and the status monitoring system releasing a tracer material to indicate the status of the fluid control system.

Because of the pressure differential between the high pressure of the well fluid in the first chamber 426 and the low pressure (atmospheric pressure) in the second chamber 428, the sleeve 412 is actuated and forced to move in an upward direction in FIG. 4 (in a different embodiment, the sleeve can move in a downward direction), which eventually opens up the port 416, as illustrated in FIG. 5. As the containment vessel 432 moves together with the inner sleeve 412, a puncturing member 450, which is attached to the lower part 414B of the body 414, opens up the containment vessel 432 and releases the tracer material 434 into the third chamber 429, which now directly communicates with the wellbore 408, as shown in FIG. 5. In fact, due to the movement of the inner sleeve 412, the port 416 is now in fluid communication with the wellbore 408. The tracer material 434 enters into the well fluid 406, and travels to the head of the well, where the tracer material is detected and associated with the corresponding valve, as each valve is provided with a unique tracer material.

Figure 6:
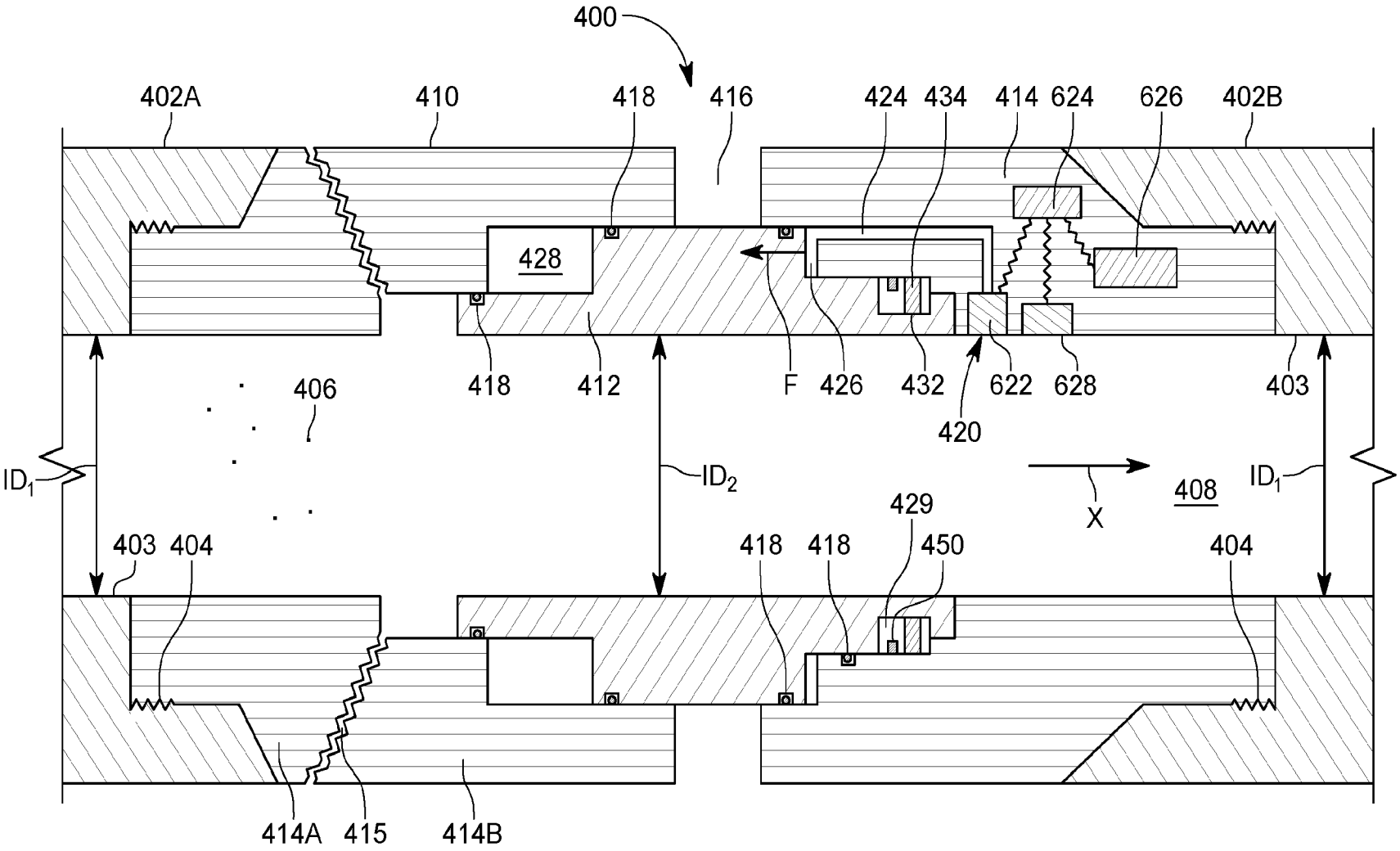
FIG. 6 illustrates another novel fluid control system equipped with a status monitoring system that indicates whether the fluid control system has been opened.

In another embodiment, as illustrated in FIG. 6, the actuation mechanism 420 is an electronic mechanism. More specifically, the actuation mechanism 420 includes a dump valve 622 that fluidly communicates the conduit 424 to the wellbore 408. The dump valve 622 is an electronically controlled valve, which is opened and closed when instructed by a controller 624. Controller 624 is electrically connected to a power source 626, that is configured to supply electrical power. In one application, the power source 626 is a battery that provides DC current. The controller 624 is also connected to a start switch 628 that is directly exposed to the fluid 406 in the wellbore 408. In one application, the controller 624, the power source 626, and the start switch 628 are also part of the actuation mechanism 420. All these elements of the actuation mechanism 420 are in this embodiment fully provided within the lower part 414B of the body 414, for example, in a wall of the body.

Figure 7:
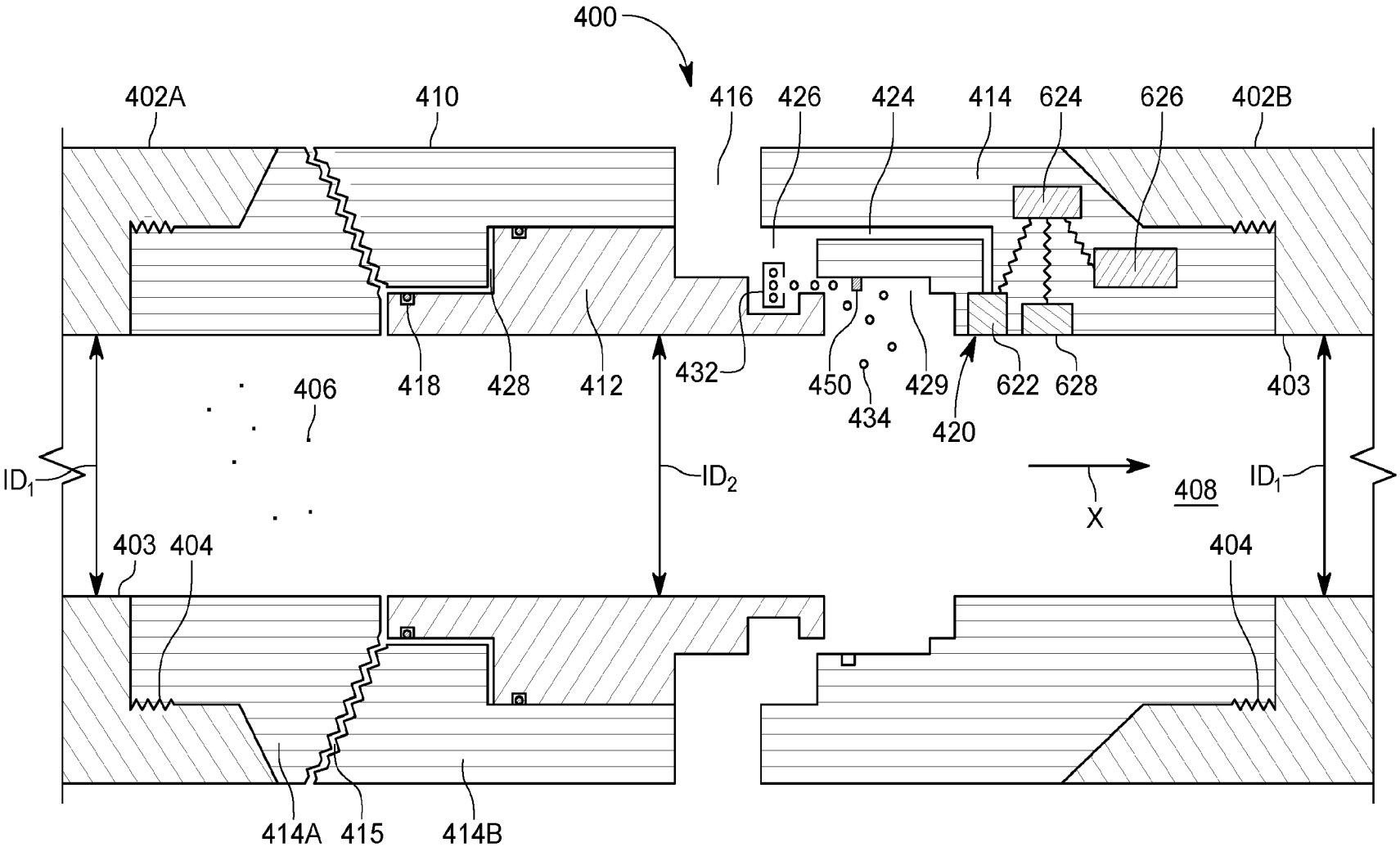
FIG. 7 illustrates the another fluid control system being opened and the status monitoring system releasing a tracer material to indicate the status of the fluid control system.

In operation, the start switch 628 is configured to determine when a pressure inside the wellbore is larger than a given pressure. This pressure is selected by the operator of the well. When the operator needs to actuate the inner sleeve 412, the operator increases the pressure of the fluid inside the wellbore, until the start switch 628 is activated. When this happens, a signal is transmitted from the start switch 628 to the controller 624. The controller 624, aware now that the pressure inside the wellbore is over the given pressure, electronically instructs the dump valve 622 to open, so that the fluid 406 can enter through the conduit 424 into the first chamber 426, to initiate the movement of the inner sleeve 412. Because the pressure inside the second chamber 428 is smaller than the given pressure, the inner sleeves moves from the first chamber toward the second chamber to open the port 416. At the same time, the containment vessel 432, if present in the third chamber 429, moves together with the inner sleeve 412, and gets punctured by the puncturing member 450, which results in the release of the tracer material 434 as illustrated in FIG. 7. Note that the tracer material 434 can be provided directly in the third chamber, with no containment vessel 432. In one application, the controller 624, which can be a processor, can be programmed to apply a time delay after receiving the signal from the pressure switch 628 that the desired pressure in the wellbore has been reached.

Figure 8A:
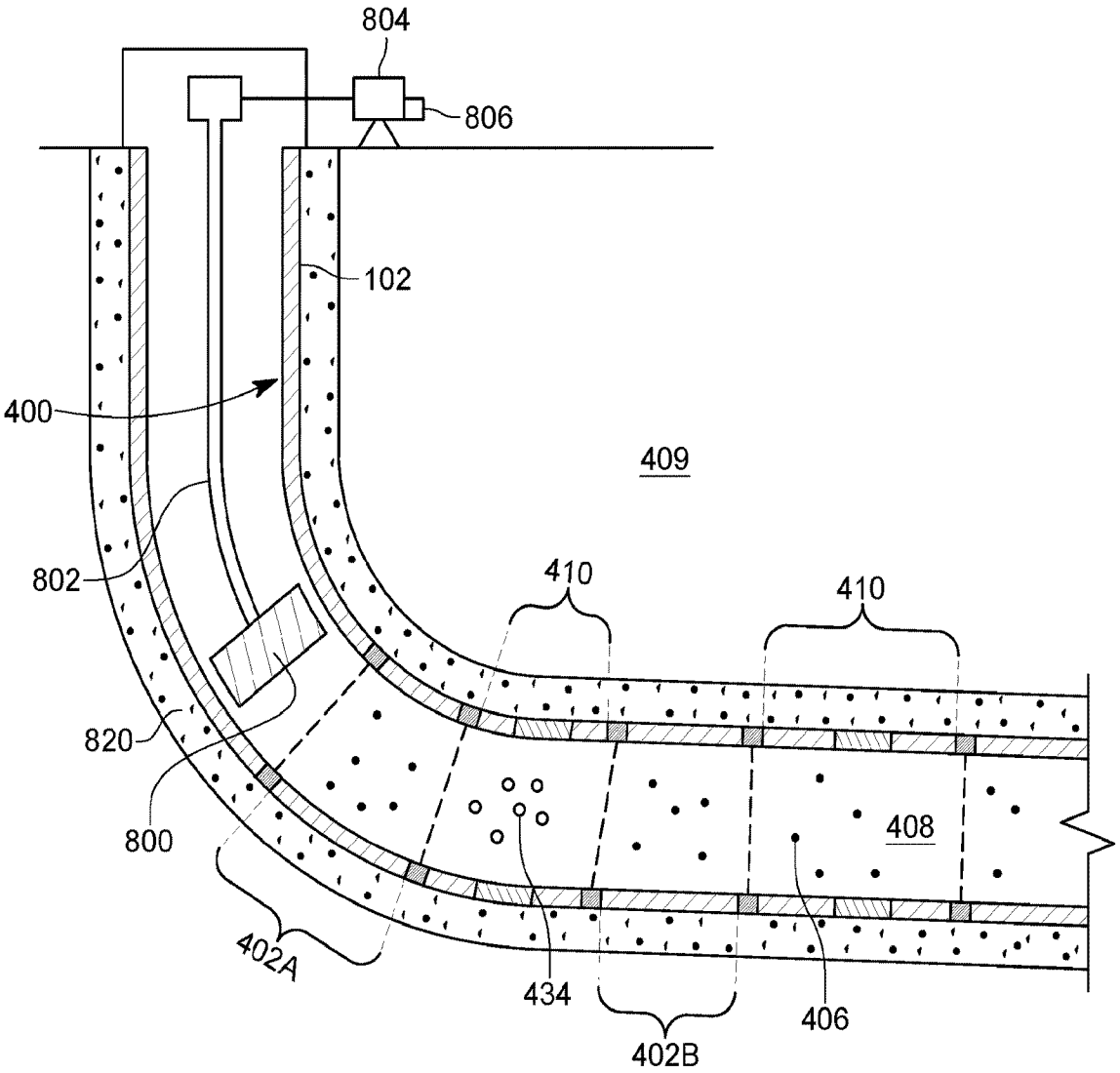
FIG. 8A illustrates the fluid control system and the associated status monitoring system being implemented in the casing of a well.

After the tracer material 434 is released into the wellbore 408, as shown in FIG. 8A, the tracer material 434 becomes mixed with the well fluid 406 (e.g., oil, gas, water) and may encounter a production pump 800, which is placed in the well and configured to move the oil from the well to the surface along a tubing 802. The production pump 800 is generally designed to pump sand with the well fluid 406, and the sand present in the well fluid 406 may have a grain size of typically about 2 mm in diameter. Hence, the tracer material 434 is preferably of a sufficient size to be pumped, or transferred through or around the blockages of the pumping equipment 800 through the tubing 802, in the well. The fluids are collected in the surface tank 804 and there, an appropriate device 806 identifies which tracer material is present. The device 806 may be a microscope, electronic microscope, a camera, a spectroscopy system, a magnetometer, etc., depending on the type of the tracer material.

Figure 8B:
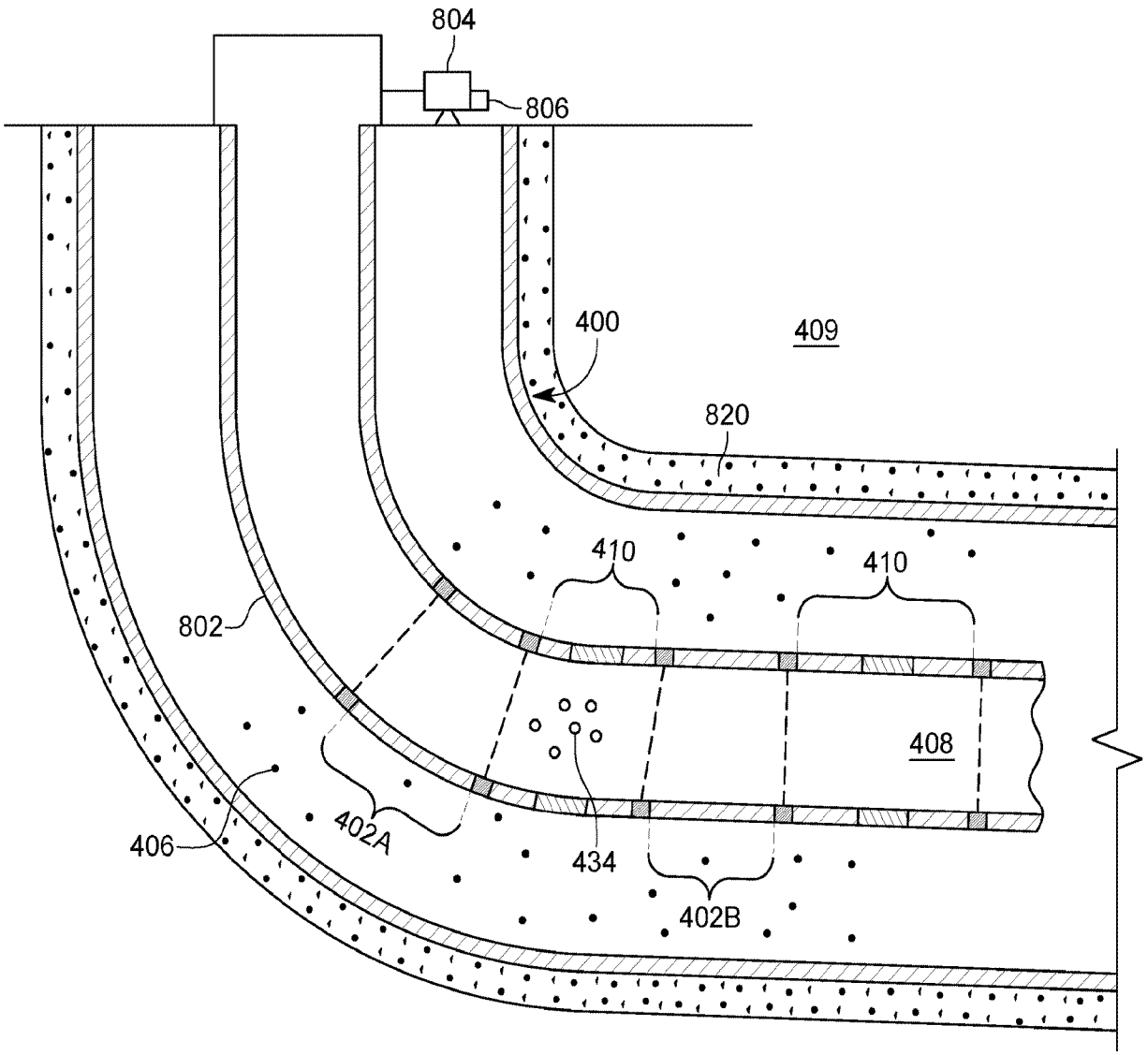
FIG. 8B illustrates the fluid control system and the associated status monitoring system being implemented in a tubing that is lowered into the casing of a well.

While FIG. 8A shows an embodiment in which the fluid control devices 410 are interposed between casing elements 402A and 402B (which form the casing 400, which is cemented in place with cement 820 inside the well), FIG. 8B illustrates another possible implementation of the fluid control devices 410. In this embodiment, the fluid control devices 410 are interposed between casing elements 402A and 402B that form a production tubing 802, and not the actual casing 400 that lines the well. In another words, in this embodiment, the fluid control devices 410 control a fluid flow from the bore 408 of the production tubing 802 to the annulus formed by the production tubing 802 and the casing 400, and not to the formation 409, which encloses the casing 400. Note that in both the embodiment of FIG. 8A and the embodiment of FIG. 8B, the elements of the casing 400 and the elements of the production casing 802 are called casing elements 402A and 402B. However, the casing elements 402A and 402B are in neither embodiment the elements of a sand screen tool.

Figure 9:
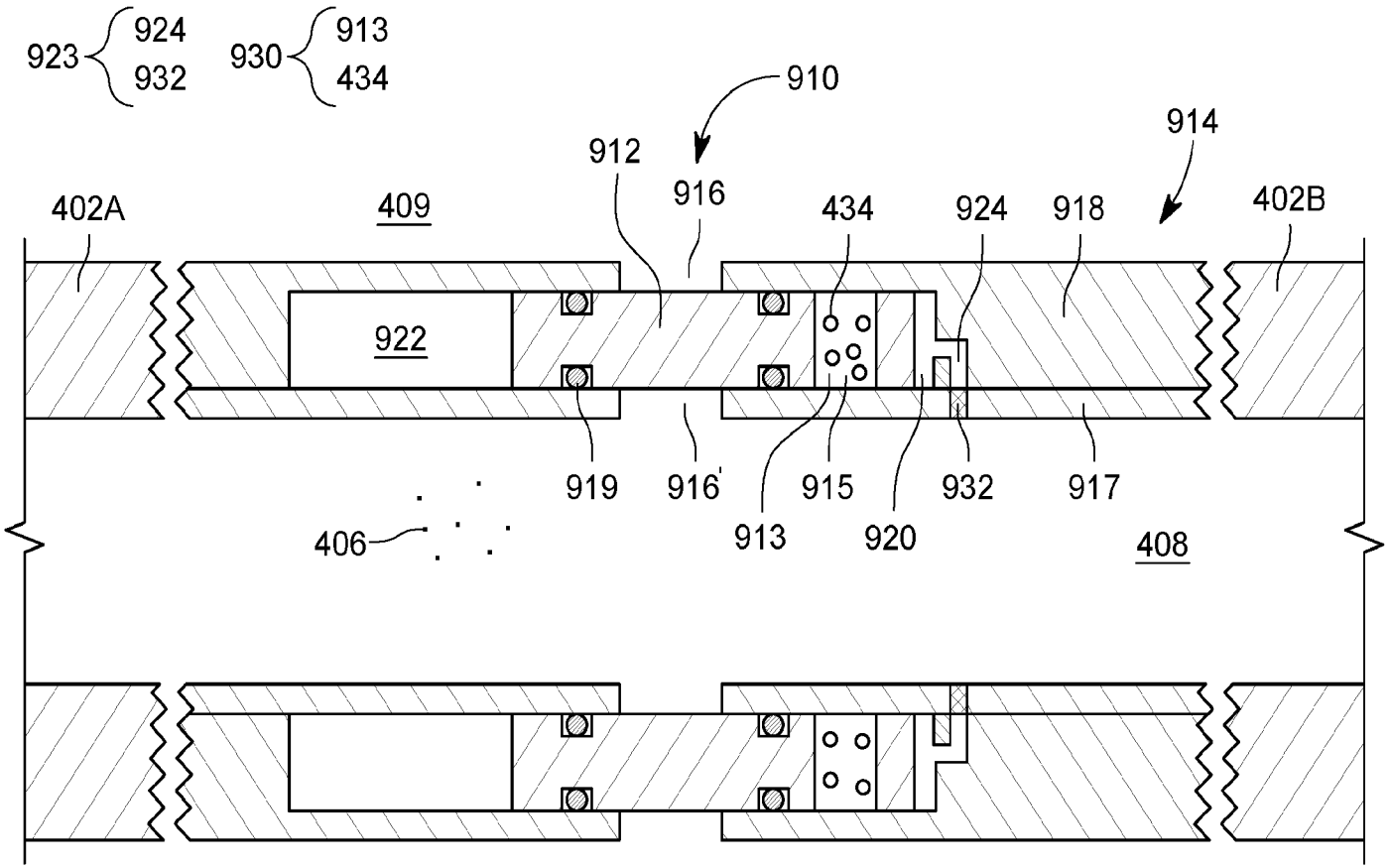
FIG. 9 illustrates yet another novel fluid control system equipped with a status monitoring system that indicates whether the fluid control system has been opened.

In still another embodiment, the tracer material 434 may be located directly within an inner sleeve 912 of a flow control device 910, as illustrated in FIG. 9. More specifically, the fluid control device 910 is configured to be connected directly between two casing elements 402A and 402B of the casing 400. The fluid control device 910 may have an inner sleeve 912 that is configured to slide inside a body 914. The body 914 may be made of an inner part 917 and an outer part 918, which covers and encloses the inner part 917 so that first and second chambers 920 and 922 are formed within the body 914. The sleeve 912 is placed between the inner part 917 and the outer part 918 to separate the first chamber 920 from the second chamber 922. Note that the inner and outer chambers are fully defined by the inner and outer parts of the body 914, and the inner sleeve 912.

Figure 10:
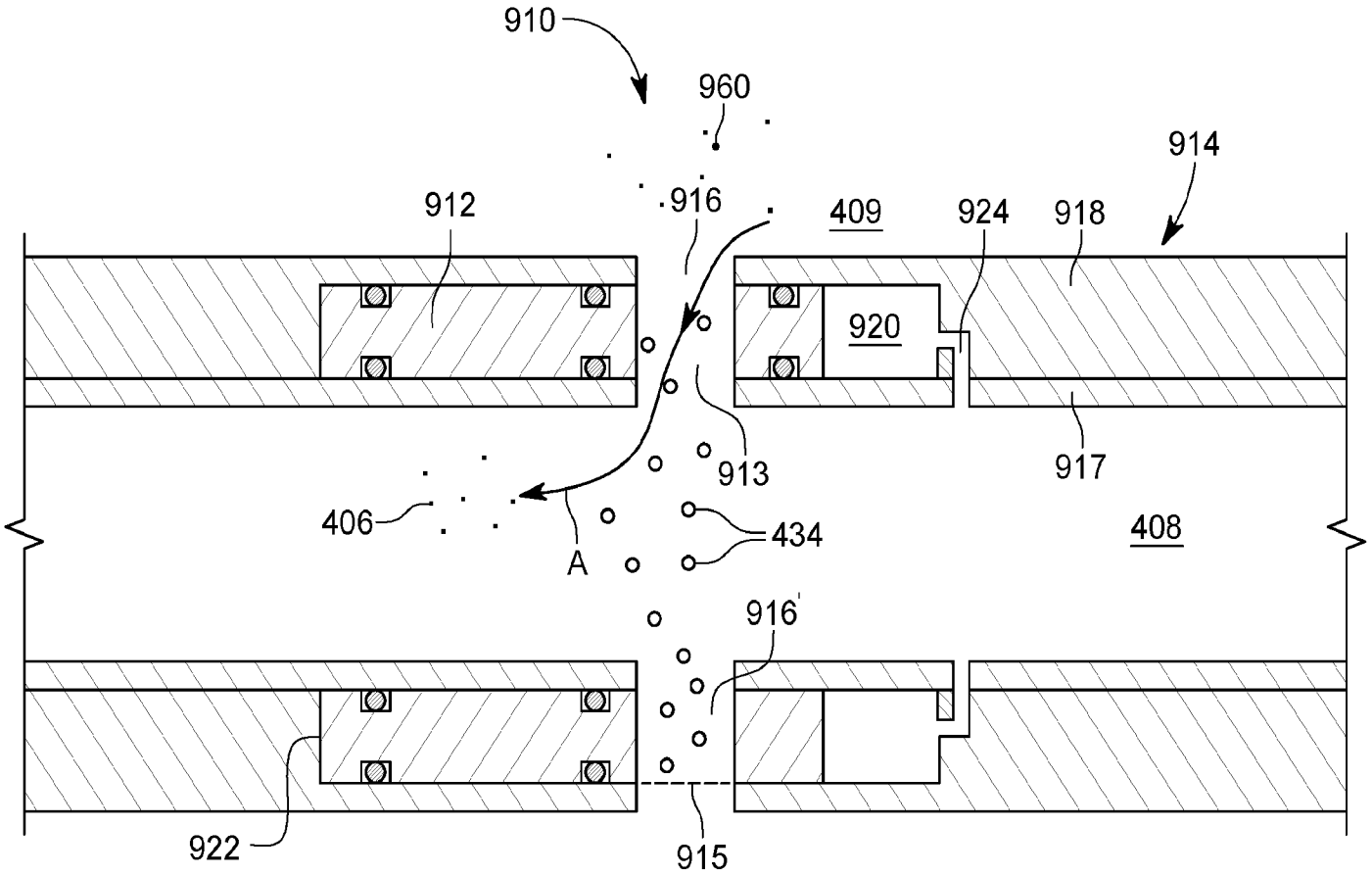
FIG. 10 illustrates the yet another fluid control system being opened and the status monitoring system releasing a tracer material to indicate the status of the fluid control system.

In this embodiment, the inner sleeve 912 has a chamber 913 formed within the sleeve 912 and this chamber is configured to hold the tracer material 434. Thus, in this embodiment, a status monitoring system 930 includes the chamber 913, which has one or more ports 915, and the tracer material 434. Because of the one or more ports 915, the chamber 913 is in fluid communication with the wellbore 408 only when the inner sleeve 912 moves in an open position, as illustrated in FIG. 10, to expose the one or more ports 915 to the wellbore 408. The inner sleeve 912 is configured to move to the left in FIG. 10, to reduce the size of the second chamber 922 to almost zero, so that the port in the chamber 913 is aligned to one or more ports 916 formed in the outer part 918 of the body 914 and also to one or more ports 916' formed in the inner part 917 of the body 914. For this situation, the fluid 960 present in the formation 409, around the body 914, may enter the chamber 913 and combine with the tracer material 434 and move upward in the casing, as indicated by arrow A, eventually arriving at the head of the well.

To move the inner sleeve 912 from the closed position shown in FIG. 9, to the open position shown in FIG. 10, an actuating mechanism 923 includes a conduit 924, which may be formed in the body 914, to fluidly communicate the wellbore 408 with the first chamber 920. The conduit is closed by a burst disc 932, which prevents the well fluid 406 entering the first chamber 920. The bust disc 932 is also part of the actuating mechanism 923. When the pressure inside the wellbore 408 is increased over a given value, the burst disc 932 is designed to break and allow the wellbore fluid 406 to enter the first chamber 920 through the conduit 924. Because the pressure in the second chamber 922 (atmospheric pressure) is lower than the pressure of the wellbore fluid, the inner sleeve 912 moves from the right to the left in the figure, which results in the substantial reduction of the volume of the second chamber 922, as shown in FIG. 10. The various o-rings 919 shown in the figures are used to prevent the high pressure of the well to enter the first and second chambers 920 and 922 before the operator intends to do so. Those skilled in the art would understand that the embodiment of FIG. 6 and that of FIG. 9 can be combined, e.g., to provide the electronic actuation mechanism of the inner piston 412 in FIG. 6 for the inner sleeve 912 of FIG. 9.

Figure 11:
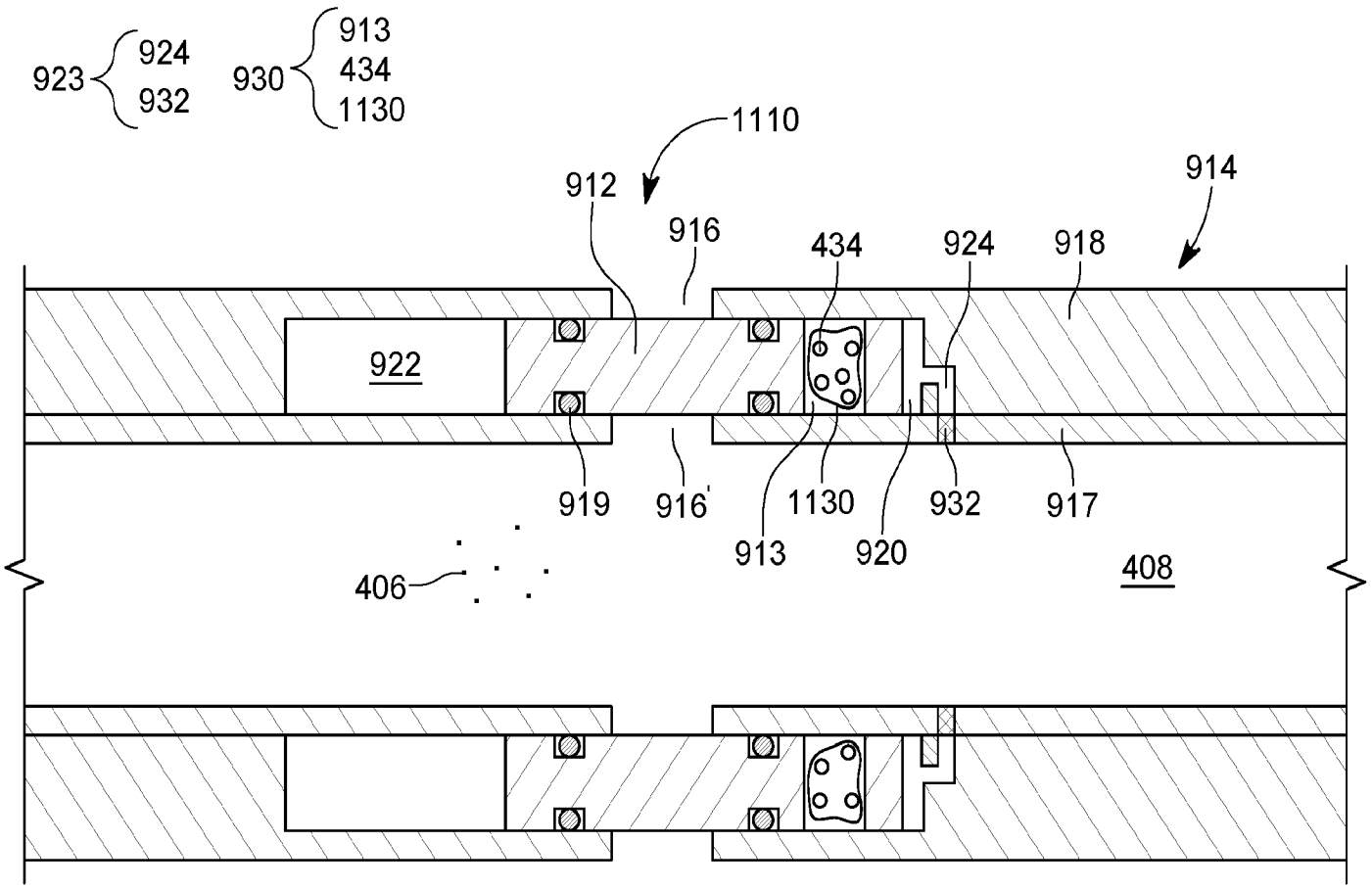
FIG. 11 illustrates still another novel fluid control system equipped with a status monitoring system that indicates whether the fluid control system has been opened.
Figure 12:
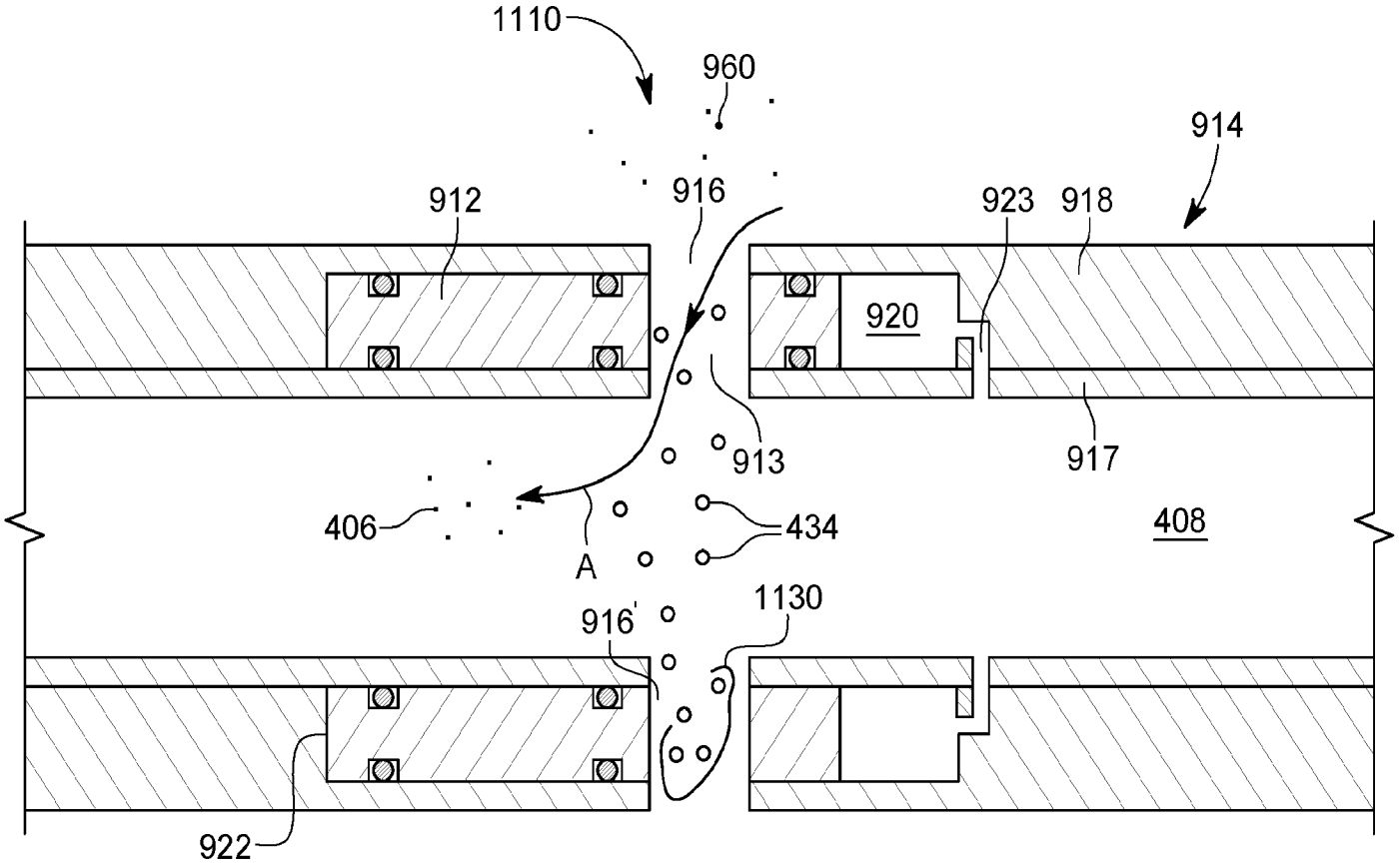
FIG. 12 illustrates the still another fluid control system being opened and the status monitoring system releasing a tracer material to indicate the status of the fluid control system.

In another embodiment illustrated in FIGS. 11 and 12, the tracer material 434 is placed into a containment vessel 1130. The containment vessel 1130 is designed to break when exposed to the hydrostatic pressure that is present in the wellbore. Thus, when the inner sleeve 912 is opened as show in FIG. 12, and the containment vessel 1130 is exposed at the high hydrostatic pressure of the wellbore, the containment vessel 1130 breaks and the tracer material 434 is released into the wellbore. All the other elements in this embodiment are similar to those in the previous embodiment, and for this reason, those common elements are not described again.

Figure 13:
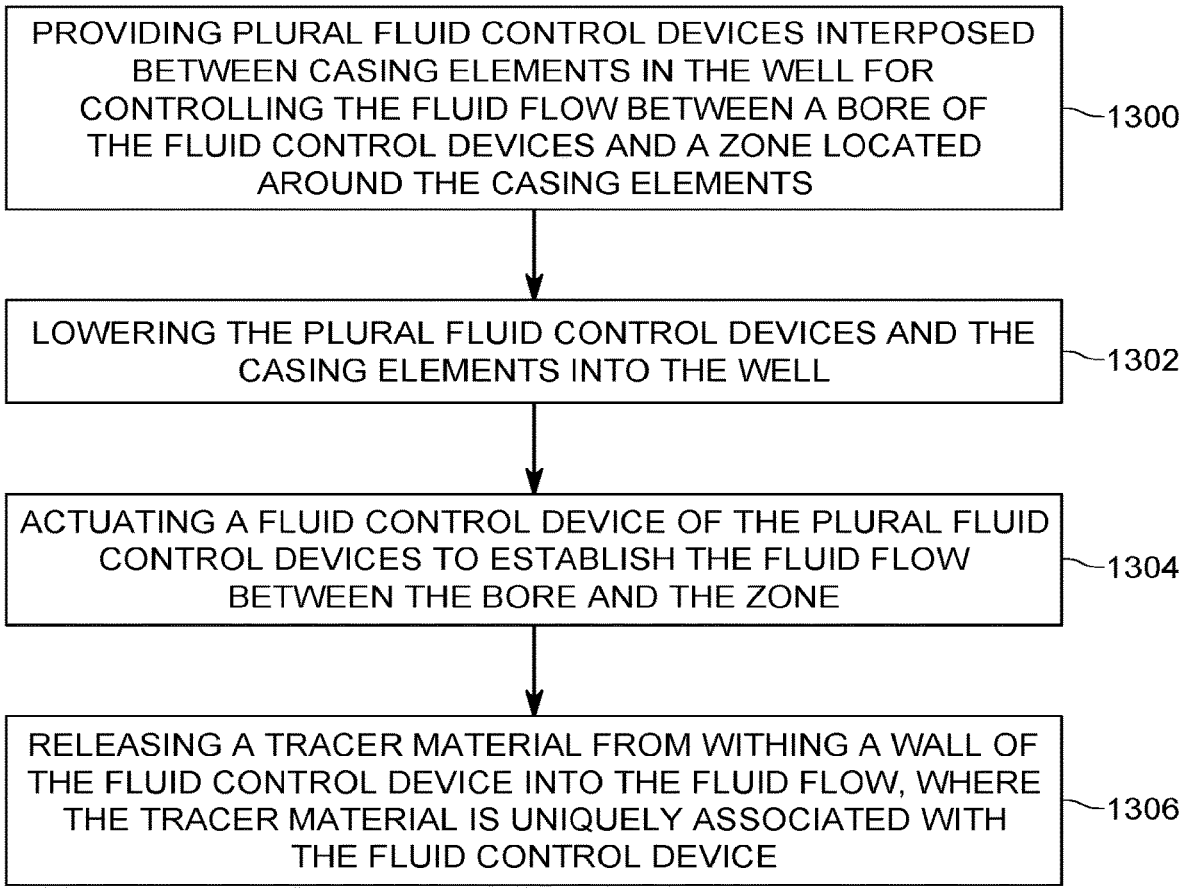
FIG. 13 is a flowchart of a method for establishing fluid communication between a bore of a fluid control system and a zone outside the system and providing an indication that the fluid communication has been established.

A method for controlling a fluid flow in a well is now discussed with regard to FIG. 13. The method includes a step 1300 of providing plural fluid control devices 410 interposed between casing elements 402A, 402B in the well for controlling the fluid flow between a bore 408 of the fluid control devices 410 and a zone 409 located around the casing elements 402A, 402B, a step 1302 of lowering the plural fluid control devices 410 and the casing elements 402A, 402B into the well, a step 1304 of actuating a fluid control device 410 of the plural fluid control devices 410 to establish the fluid flow between the bore 408 and the zone 409, and a step 1306 of releasing a tracer material 434 from within a wall of the fluid control device 410 into the fluid flow, where the tracer material 434 is uniquely associated with the fluid control device 410. In one application, the tracer material is released by a status monitoring system integrated within the wall of the fluid control device. The tracer material may be located in a chamber defined by an inner sleeve and a body of the fluid control device. In another application, the tracer material is located in its entirety within the inner sleeve.

The disclosed embodiments provide a fluid control device and an associated and integrated status monitoring system that is capable to indicate whether the fluid control device has opened or not. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for controlling a fluid flow in a well, the method comprising:

providing a fluid control device comprising a body defining an inner chamber, a throughbore, an upper end, and a lower end;

connecting the upper end of the fluid control device to an upper casing element;

connecting the lower end of the fluid control device to a lower casing element;

lowering the fluid control device and the upper and lower casing elements into the well, such that an annulus is formed between the casing elements and the well;

actuating the fluid control device to establish fluid flow between the throughbore and the annulus and to open the inner chamber; and releasing a tracer material from within the inner chamber of the fluid control device into the fluid flow, wherein the tracer material is uniquely associated with the fluid control device.

2. The method of claim 1, wherein the inner chamber is defined only by an inner sleeve and a body of the fluid control device.

3. The method of claim 1, wherein the tracer material is located in its entirety within the inner sleeve.

* * * * *